United States Patent [19]

Keiji

[11] Patent Number: 4,643,691

[45] Date of Patent: Feb. 17, 1987

[54] ARTICULATED DOLL ARRANGEMENT

[75] Inventor: Iwabuchi Keiji, Tokyo, Japan

[73] Assignee: Kawada Co., Ltd., Tokyo, Japan

[21] Appl. No.: 740,020

[22] Filed: May 31, 1985

Related U.S. Application Data

[63] Continuation-in-part of Ser. No. 532,781, Sep. 16, 1983, Pat. No. Des. 280,649.

[30] Foreign Application Priority Data

Jul. 6, 1984 [JP] Japan ..... 59-27763

[51] Int. Cl.[4] ..... A63H 3/16; A63H 3/46; A63H 3/36

[52] U.S. Cl. ..... 446/97; 446/376; 446/390

[58] Field of Search ..... 446/97–99, 446/100, 369, 376, 377, 381, 384, 390, 383

[56] References Cited

U.S. PATENT DOCUMENTS

| | | | |
|---|---|---|---|
| 2,021,115 | 11/1935 | Jackson | 446/383 |
| 3,099,895 | 8/1963 | Beebe | 446/376 |
| 3,645,038 | 2/1972 | Morrison et al. | 446/390 X |
| 3,955,312 | 5/1976 | Pugh | 446/390 X |
| 3,995,395 | 12/1976 | Rahmstorf | 446/100 |
| 4,103,451 | 8/1978 | Kawada et al. | 446/383 X |
| 4,136,481 | 1/1979 | Nicholls | 446/381 |
| 4,185,412 | 1/1980 | Rahmstorf | 446/100 X |
| 4,519,786 | 5/1985 | Larws | 446/97 |

FOREIGN PATENT DOCUMENTS

| | | | |
|---|---|---|---|
| 1385653 | 2/1975 | United Kingdom | 446/97 |

*Primary Examiner*—Robert A. Hafer
*Assistant Examiner*—D. N. Muir
*Attorney, Agent, or Firm*—Don B. Finkelstein

[57] ABSTRACT

An articulated doll arrangement having a head, a body, arms, upper legs, lower legs and hands. The parts of the articulated doll are interconnected to provide simulated anthropomorphic movements between various of the parts. A central connecting member extends through the hollow body means and projects from the top of the body upon which the head having a simulated neck is pivotally mounted. The remote end of the central connecting has the two upper legs pivotally mounted thereon adjacent the bottom edges of the body. A simulated shoulder joint is provided on the sides of the body adjacent the top and the arms are pivotally connected at the shoulder connecting joints. Hands are detachably mounted in the remote ends of the arms. Lower legs are pivotally connected to the upper legs at a simulated knee joint.

19 Claims, 10 Drawing Figures

FIG. 3
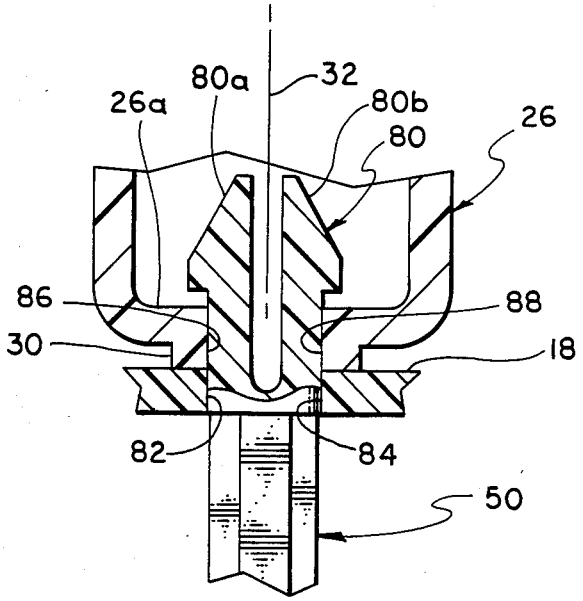
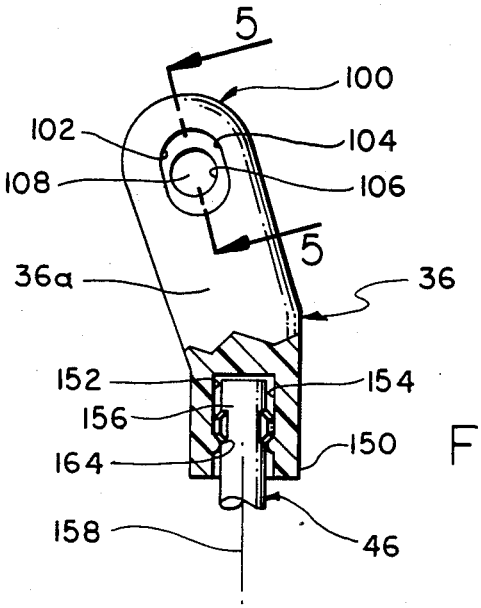
FIG. 4
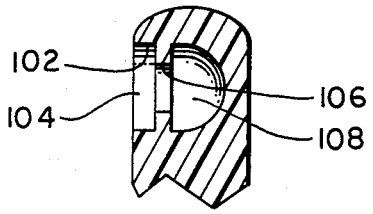
FIG. 5
FIG. 6
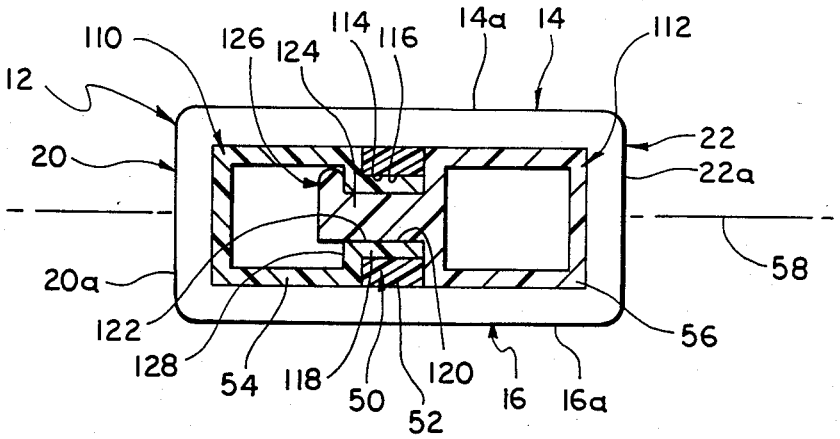

FIG. 7
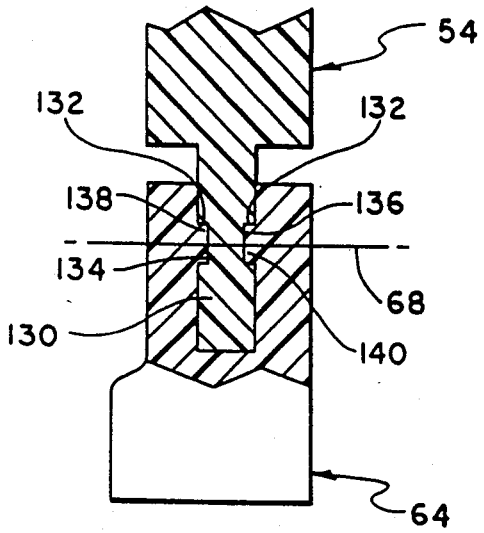
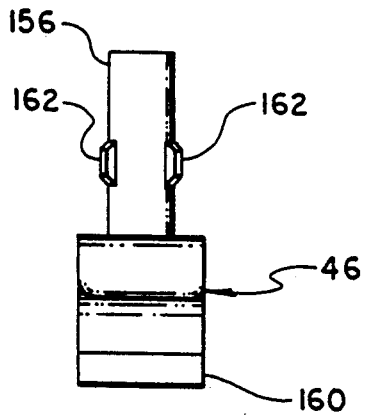
FIG. 8
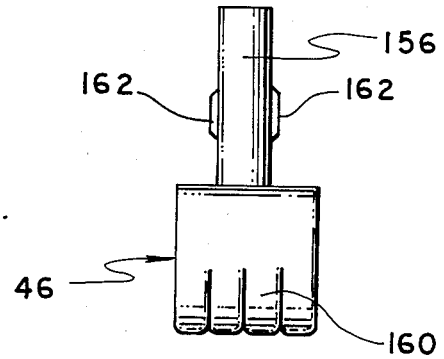
FIG. 9
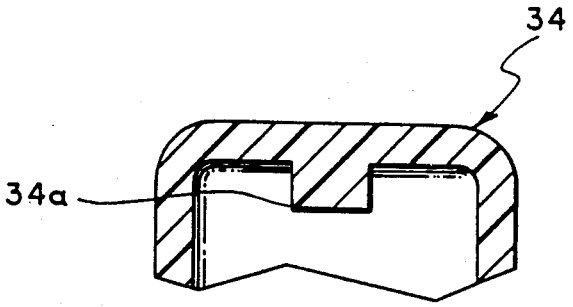
FIG. 10

ARTICULATED DOLL ARRANGEMENT

REFERENCE TO RELATED APPLICATIONS

This application is a continuation in part of my design patent application, Ser. No. 532,781, filed 9-16-83, now U.S. Pat. No. D280649.

BACKGROUND OF THE INVENTION

1. Field of the Invention

This invention relates to the toy art and more particularly to an improved articulated doll arrangement having simulated anthropomorphic movements.

2. Description of the Prior Art

Toys in the form of dolls simulating the human shape have been known in prehistory times. Such dolls in the forms of humans or animals have been utilized for millenia not only as toys for the amusement and education of children but also in many mystical and/or semi-religious activities.

Articulated dolls, that is dolls having portions thereof movable with respect to each other, have also long been known and long utilized. Further, articulated dolls having anthropomorphic movement, that is movement simulating the movement of the various portions of the human and/or animal anatomy which the doll simulates, have also long been known and such articulated dolls provide, when utilized as toys, even greater enjoyment and pleasure for children since the various portions of the body can be moved in various ways to simulate the actual movements of the human body. Such simulation, of course, enhances the play value of toys as well as aiding in the development of manual dexterity of the children.

In addition to anthropomorphic movement in such dolls, it has been found that additional movements which may not necessarily correspond to allowable movement of the actual entity which the doll simulates tends to increase the enjoyment and play value of the doll. Such additional movements may comprise, for example, the ability to rotate a head 360 degrees with respect to the body. While such movements of the head or other portions of the anatomy which are not found in the corresponding entity which the doll simulates are often termed "silly" movements, it has been found that children in the learning stages find greatly enhanced play value when such movements can be achieved.

Dolls simulating human and/or animal forms, of course, come in many sizes. One such doll is shown in U.S. Pat. No. 4,103,451 which provides some form of simulated anthropomorphic movements. However, in even smaller dolls than shown therein, such as a doll simulating a human but having an overall length of, for example, an inch and a half, is often desired for utilization with, for example, other toys and games of the child's. In such small or miniaturized dolls, it has heretofore been found extremely difficult to provide the desired anthropomorphic and/or silly movements desired in such dolls to provide the increased enjoyment and play value of the doll. Further, in such miniaturized or small dolls, the ability to join together and/or disassemble some of the components making up the doll has also been found to enhance the play value by allowing the child to utilize imagination in combining various portions in interesting and/or amusing combinations. Such detachable coupling of the components of the doll, particularly in the miniaturized dolls as above described, further aid in the development of the manual dexterity of the child.

SUMMARY OF THE INVENTION

Accordingly, it is an object of the present invention to provide an improved articulated doll arrangement.

It is another object of the present invention to provide an improved miniaturized articulated doll arrangement having at least some anthropomorphic movements associated with the components thereof.

It is yet another object of the present invention to provide an improved articulated doll having movements between the parts thereof not associated with the actual figure which the doll represents.

It is yet another object of the present invention to provide an improved miniaturized articulated doll arrangement having a high degree of play value and capable of comparatively rapid manufacture and assembly to provide an inexpensive toy.

The above, and other objects of the present invention, are achieved, according to a preferred embodiment of the present invention by providing a miniaturized articulated doll comprising a body means, a head means with a simulated neck portion pivotally mounted on the body means, a pair of arm means mounted on the body means at simulated shoulder joints thereof, a pair of hand means connected to the remote ends of the arm means and the connection of the hand means may be pivotal and detachable. Upper leg means are mounted on the body means and are pivotally movable in a simulated hip movement and lower leg means are pivotally mounted to the upper leg means at a simulated knee joint for simulated knee movement.

In the preferred embodiment of the present invention, a detachable head covering which may simulate hair, helmet, cap or any other desired covering is detachably mounted on the head means.

A central connecting member extends through the hollow body member and has a portion extending from the top thereof upon which the neck portion of the head means is pivotally mounted. The lower end of the central connecting member provides the simulated hip joint and the upper leg portions are pivotally mounted on the lower end of the central connecting member. The upper leg means has limited rotational movement with respect to the body means to simulate at least partially the anthropomorphic movement of the upper legs and, as such, are pivotally movable to a position extending substantially in from of and at right angles to the body means and pivotally movable rearwardly toward the rear of the body to approximately a 45 degree angle with the body means. The lower leg means are pivotally mounted on the upper leg means at the simulated knee joint and are movable toward the back of the body means similar to the anthropomorphic movement of the human leg, but stops are provided to prevent pivotal movement toward the front of the body means beyond an aligned condition of the lower leg means and upper leg means.

The hand simulating means are pivotally mounted in the arm means and are preferably detachable therefrom so that different types of hand simulating portions such as those simulating a hook, those simulating fingers, or the like, may be interchanged in the doll. The shoulder mounting means provides rotational movement of the arm means with respect to the body means about three mutually perpendicular axes. One of the pivotal movements is 360 degrees about a first of the axes to simulate the anthropomorphic movement of the arm and a limited pivotal movement is provided about the other two of the three mutually perpendicular axes to simulate the anthropomorphic movement of the human arm.

BRIEF DESCRIPTION OF THE DRAWINGS

The above, and other objects of the present invention, may be more fully understood from the following detailed description taken together with the accompanying drawings wherein similar reference characters refer to similar elements throughout, and in which:

FIG. 3 is a sectional view illustrating the simulated neck connection of the doll of FIG. 1;

FIG. 4 illustrates, partially in section, an arm means of the doll of FIG. 1;

FIG. 5 is a sectional view along the line 5—5 of FIG. 4;

FIG. 6 is a sectional view illustrating the hip joint of the doll of FIG. 1;

FIG. 7 is a partial sectional view illustrating the knee joint of the doll of FIG. 1;

FIG. 8 illustrates a hand means of the doll of FIG. 1;

FIG. 9 illustrates another embodiment of a hand means useful in the practice of the present invention; and FIG. 10 is a partial sectional view of a head covering of the doll of FIG. 1.

DESCRIPTION OF THE PREFERRED EMBODIMENTS

Figure 1:
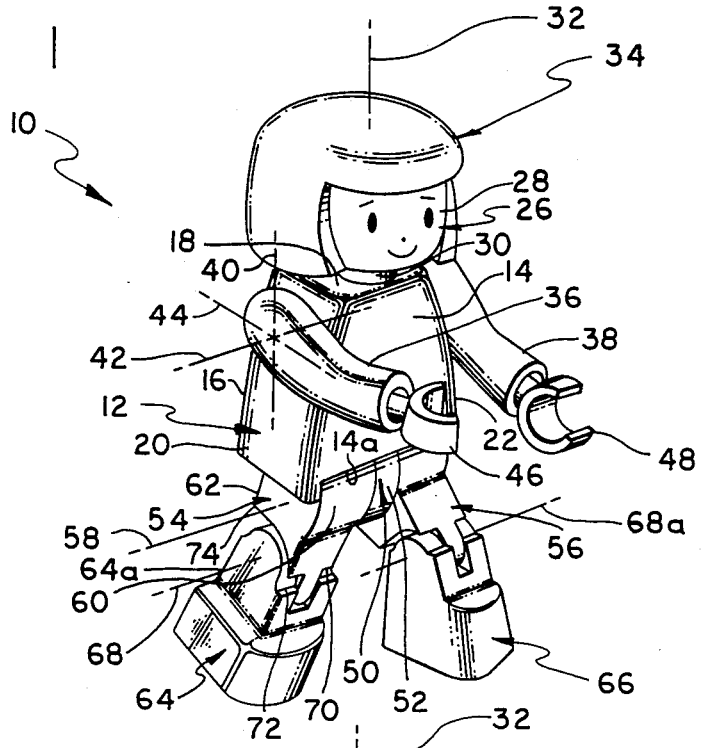
FIG. 1 is a perspective view of an articulated doll according to the principles of the present invention.

Referring now to FIG. 1, there is illustrated a miniature articulated doll arrangement generally designated 10 according to the principles of the present invention. The articulated doll arrangement 10 generally comprises a body means 12 having a front wall 14, a back wall 16 spaced from the front wall 14, a top wall 18 and spaced apart side walls 20 and 22. As described below, in connection with FIG. 2, the front wall 14, back wall 16, top wall 18 and side walls 20 and 22 define an open bottom body cavity generally designated, in FIG. 2, as 24. Each of the front wall 14, back wall 16 and side walls 20 and 22 have lower edges shown on FIG. 2 as 14*a*, 16*a*, 20*a* and 22*a* spaced from the top wall 18. The lower edge 16*a* of the back wall 16 and the lower edges 20*a* and 22*a* of the side walls 20 and 22, respectively, are spaced a greater preselected distance from the top wall 18 than the lower edge 14*a* of the front wall 14.

The miniature articulated doll 10 further comprises a head means 26 having a head simulating portion 28 and a neck simulating portion 30. The neck simulating portion 30 extends from the head simulating portion 28. The head means 26 is pivotally mounted for rotation about a longitudinal axis generally designed 32 and, in preferred embodiments of the present invention, the head means 26 rotates 360 degrees about the longitudinal axis 32. This type of pivotal movement is a "silly" movement and, thus, is not truly anthropomorphic. A head covering means generally designed 34 is mounted on the head means 26 and, preferably, is detachably mounted thereon.

A pair of arm means generally designated 36 and 38 are pivotally mounted on the body means 12 for rotation about three mutually perpendicular axes. As shown on FIG. 1, the three mutually perpendicular axes for arm means 36 are generally designated 40, 42 and 44. It will be appreciated, of course, that arm means 38 is similarly mounted.

A pair of hand means generally designated 46 and 48 are pivotally mounted, preferably detachably pivotally mounted, in the arm means 36 and 38, respectively. As shown on FIG. 1, the hand means 46 and 48 have hand simulating portions simulating a hook. As described below in greater detail, other simulations in the hand simulating portions thereof may also be provided.

Figure 2:
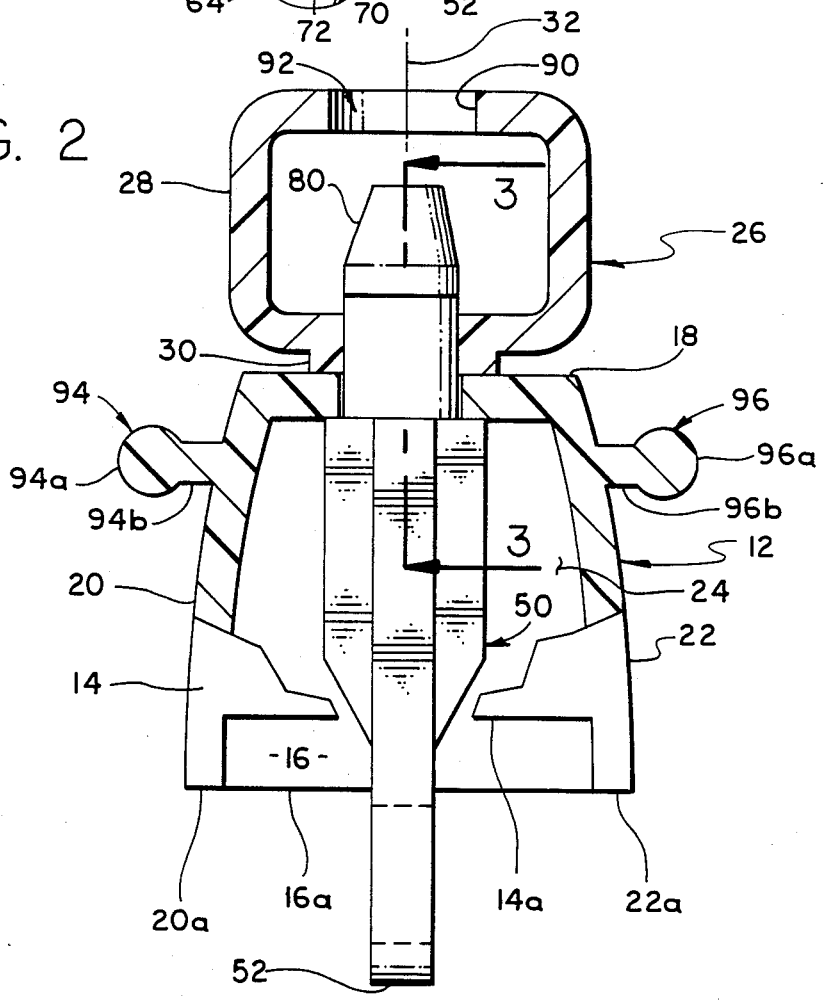
FIG. 2 is a sectional view through the body means of the articulated doll of FIG. 1.

A central connector means generally designated 50 is mounted in the open bottom body cavity 24 as illustrated in FIG. 2. The central connector means 50 has an upper leg connecting portion 52 extending a third preselected distance from the top wall 14 of the body means 12. The upper leg connecting portion 52 is utilized to provide a simulated hip joint and a pair of upper leg means 54 and 56 are mounted in the upper leg connecting portion 52 of the central connector means 50 for pivotal movement about a hip axis generally designated 58. The pivotal movement of the upper leg means 54 and 56 about the hip axis 58 is limited to provide a simulation of the anthropomorphic movement of the upper leg of the human body. This limited pivotal movement is provided by the structure of the upper leg means 54 and 56 interacting with the structure of the body means 12. The pivotal mounting of each of upper leg means 54 and 56 is similar. As illustrated for upper leg means 54, upper leg means 54 has a first stop means comprising a forward wall 60 that during rotation about the hip axis 58 toward the front wall 14 engages the lower edge 14*a* of the front wall 14 to limit the pivotal motion of the upper leg means 54 to a position where it extends substantially at right angles outwardly from the front wall 14. Similarly, the back wall 62 of the upper leg means 54 engages the lower edge 16*a* of the back wall 16 of the body means 12 during rotational movement of the upper leg 54 about the hip axis 58 toward the back wall 16 to limit the pivotal motion to an angle of approximately 45 degrees from the back wall 16.

Lower leg means 64 and 66 are pivotally mounted on the upper leg means 54 and 56, respectively, for limited rotational movement about a knee axis generally designated 68 and 68*a*. The limited rotational movement about the knee axis 68 (and 68*a*) of the leg means 64 and 66, respectively, is provided to simulate the anthropomorphic movement of the knee of a human being. This is achieved by having a lower lip 70 on the upper leg portion 54 engage a ledge 72 on the lower leg means 64 to limit the pivotal motion of the lower leg means 64 to an aligned condition with the upper leg means 54. Pivotal movement of the lower leg means 64 about the knee axis 68 toward the back wall 16 of the body means 12 is limited by engagement of the back wall 64*a* of the lower leg means 64 engaging the edge 74 of the upper leg means 54. The engagement limits the pivotal motion of the lower leg means 64 about the knee axis 68 toward the back wall 16 of the body means 12 to a position where it extends at substantially right angles rearwardly from the upper leg means 54. It will be appreciated, of course, that the lower leg means 66 is similarly mounted for limited pivotal rotation about the knee axis 68*a* with respect to the upper leg means 56.

Referring now to FIG. 2 and FIG. 3, as noted above the central connector means 50 extends through the open bottom body cavity 24. The central connector means 50 has a neck connecting portion 80 extending through an aperture 82 defined by walls 84 and the top wall 18 to regions external the body cavity 24. The head means 26 is pivotally mounted on the neck connecting portion 80 with respect to the body means 12 about the next axis 32. The neck portion 30 of the head means has walls 86 defining an aperture 88 therethrough and the neck connecting portion 80 of the central connector means 50 extends through the aperture 88. The tabs 80*a* and 80*b* of the neck connecting portion 80 engage an internal ledge 26*a* of the head means 26 to retain the head means 26 adjacent the top wall 18 and permitting the above described pivotal motion, preferably 360 degrees, about the neck axis 32. The head portion 28 of the head means 26 is also provided with walls 90 defining an aperture 92 therethrough for mounting of certain of the head covers 34 on the head means 26, as described below in greater detail.

The body means 12 is also provided with shoulder joint connecting portions 94 and 96 extending outwardly from the side walls 20 and 22, respectively. As illustrated in FIG. 2, the shoulder joint connecting portions 94 and 96 are generally mushroom shaped, having a ball shaped end 94*a* and 96*a* and a stem portion 94*b* and 96*b*. As described below in greater detail, the arm means 36 and 38 are pivotally mounted on the shoulder joint connecting portions 94 and 96, respectively.

FIGS. 4 and 5 illustrate arm means 36, and it will be appreciated that arm means 38 is identical to arm means 36 except that it is a mirror image thereof. Arm means 36 has a shoulder end generally designated 100 in which there is provided walls 102 defining a slot 104 extending therein and walls 106 defining a ball cavity 108 therein. The ball shaped end 94*a* of the shoulder joint connecting portion 94 is mounted in the ball cavity 108 and the stem 94*b* extends through the slot 104. The walls 102 defining the slot 104 engage the stem portion 94*b* to limit the pivotal movement of the arm means 36 with respect to the body means 12 about the axes 40 and 42 so that 360 degrees rotation of these axes is not permitted. It will be appreciated, of course, that portions of the inner wall 36*a* of the arm means 36 may also engage the side wall 20 to limit such pivotal motion. However, rotation about the axis 42 is 360 degrees as provided by the ball end 94*a* in the ball cavity 108. It will be appreciated that the above described mounting of the arm means 36 and 38 on the body means 12 provides for independent movement of each of the arm means 36 and 38. That is, each arm means 36 and 38 may be moved independently of movement of the other arm means. Similarly, this mounting also provides for independent movement of each of the arm means 36 and 38 about each of the three axes such as 40, 42 and 44, so that movement about each of the axes may be obtained regardless of the position of the arm means with respect to the body means.

FIG. 6 illustrates a sectional view through the upper leg connecting portion 52 of the central connector means 50 and hip end connecting portions 110 and 112 of the upper leg means 54 and 56, respectively. To achieve the above described limited pivotal motion of the upper leg means 54 and 56, there is provided walls 114 in the upper leg connecting portion 52 of the central connecting portion 50 defining an aperture 116 therethrough. A boss 118 of the upper leg 54 extends through and is frictionally mounted in the aperture 116 and is provided with walls 120 defining an aperture 122 through the boss means 118. A rod portion 124 of the upper leg means 56 extends through the aperture 122 and the boss means 118 and is provided with a tab section 126 that engages inner wall 128 of the upper leg means 54 to retain the upper leg means 56 in alignment. A frictional fit is provided to allow independent rotational movement of each of the upper leg means 54 and 56. Thus, FIG. 6 illustrates a simulated hip joint of the articulated doll 10.

FIG. 7 illustrates the simulated knee joint of the articulated doll 10 for the rotation of the lower leg means 64 about the knee axis 68 with respect to the upper leg portion 54. The upper leg portion 54 is provided with a knee end portion 130 in which there are provided walls 132 defining a pair of opposed circular cavities 134 and 136. Cylindrical tab portions 138 and 140 are provided on the lower leg portion 64 and are positioned in the cavities 134 and 136 to allow the limited pivotal movement of the lower leg means 64 with respect to the upper leg means 54 about the knee axis 68.

Referring now to FIG. 8 and FIG. 4, the hand means 46 is pivotally mounted on wrist end 150 of arm means 36. It will be appreciated, of course, that hand means 48 is similarly mounted in arm means 38. Wrist end 150 of arm means 36 has walls 152 defining a hand connecting portion aperture 154 into which the hand connecting portion 156 of the hand means 46 is positioned to allow rotation about a wrist axis 158. Hand connecting portion 156 extends from the hand simulating portion 160 of the hand means 46 which, as illustrated in FIGS. 1 and 8, simulates a hook. The hand connecting portion 156 has tabs 162 which engage a shoulder 164 in the wrist end 150 of the arm means 36 for the detachable retention of the hand means 46 on the arm means 36.

FIG. 9 illustrates an alternative embodiment of a hand means generally designated 170 in which the hand simulating portion 172 thereof is provided with finger simulating means 174. The attachment of the hand means 170 to an arm means of the articulated doll of the present invention is the same as described above in connection with FIGS. 4 and 8.

FIG. 10 illustrates a head covering means 34 and, as shown, the head covering means 34 has a head covering means connector portion 34*a* which projects into the cavity 92 (FIG. 2) for retention of the head covering means 34 thereon. It will be appreciated, of course, that head covering means may be made in a variety of shapes and sizes to simulate various types of hair, hats, helmets or otherwise. Similarly, it may be desirable in some such head covering means to eliminate the head connecting portion 34*a* and have such head covering means frictionally retained on the head means 26.

This concludes the description of the preferred embodiment of the present invention. It will be appreciated that many variations and adaptations of the present invention may be made and all such variations and adaptations are intended to be covered by the appended claims.

What is claimed is:

1. Miniature articulated doll arrangement comprising, in combination:

a body means, having a front wall, a back wall spaced from said front wall, a top wall and spaced apart side walls defining an open bottom body cavity, and said top wall having walls defining an aperture therethrough, shoulder joint connecting portion on each of said side walls in regions adjacent said top wall, and each of said front wall, back wall and side walls having lower edges spaced from said top wall, and said lower edge of said back wall and said side walls spaced a first preselected distance from said top wall, and said lower edge of said front wall spaced a second preselected distance from said top wall;

central connector means in said body cavity of said body means and having a neck connecting portion extending through said aperture in said top wall and an upper leg connecting portion having a pair of spaced apart side surfaces and extending a third preselected distance from said top wall of said body means and spaced from said neck connecting portion, and said upper leg connecting portion of said central connector means extending from said open bottom body cavity;

a head means pivotally mounted for pivotal movement about the neck axis on said neck connecting portion of said central connecting means adjacent said top wall of said body means and having a head simulating portion and a neck simulating portion extending from said head simulating portion, said neck simulating portion having walls defining a neck connecting portion receiving aperture therein for receiving said neck connecting portion of said central connecting member, and said head simulating portion having a head covering connecting portion receiving aperture therein;

a pair of arm means, one of said arm means movably mounted on each of said shoulder joint connecting portions of said body means for pivotal motion thereon, said arm means having a shoulder end for pivotal connection to said shoulder joint connecting portions to define a simulated shoulder joint therebetween and a wrist end spaced from said shoulder end, said wrist end having walls defining a hand connecting portion receiving aperture therein;

a pair of hand means, one of said hand means pivotally mounted on said wrist ends of each of said arm means, and said hand means having a hand simulating portion and a hand connecting portion extending therefrom, said hand portion receiving aperture of arm said means for providing said pivotal motion of said hand means;

a pair of spaced apart upper leg means movably mounted on said upper leg connecting portion of said central connecting means for limited pivotal motion thereon about a fourth axis and having a hip end connecting portion for mounting on said upper leg connecting portion of said central connecting means to define a simulated hip joint therebetween, and a lower leg connecting portion spaced from said hip end connecting portion, a first of said pair of upper leg means pivotally mounted adjacent one of said pair of spaced apart side surfaces of said central connecting member and having a rod portion extending through said upper leg connecting portion of said central connecting member and in pivotal engagement therewith, and said rod portion having a tab section on the remote end thereof, and the second of said pair of upper leg means pivotally mounted adjacent the other of said pair of side surfaces of said central connecting member and pivotally engaging said tab section of said rod portion of said first of said pair of upper leg means and restrained adjacent said upper leg connecting portion of said central connecting member thereby;

a pair of lower leg means, one of said lower leg means movably mounted on each of said lower leg connecting portions of said upper leg means at a knee end portion thereof for limited pivotal motion about a fifth axis to simulate a knee joint therebetween, and having a foot simulating portion spaced from said knee end portion.

2. The arrangement defined in claim 1, wherein:

said upper leg means further comprises:

said hip end of said upper leg means comprises a first hip stop means for engaging said lower edge of said front wall of said body means for limiting pivotal motion of said upper leg means toward said front wall, and the second hip stop means for engaging said lower edge of said back wall of said body means for limiting pivotal motion of said upper leg means toward said back wall of said body means.

3. The arrangement defined in claim 2, wherein:

said limited pivotal motion of said upper leg means toward said front wall is to a position wherein said upper leg portions extend at substantially 90 degrees from said front wall of said body means.

4. The arrangement defined in claim 1, wherein:

said first preselected distance is greater than said second preselected distance; and said third preselected distance is greater than said first preselected distance.

5. The arrangement defined in claim 1, wherein:

said movable motion of said arms means on said shoulder connecting portion is pivotal motion about three mutually perpendicular axes.

6. The arrangement defined in claim 5, wherein:

said pivotal motion of said arm means is 360 degrees about a first of said three mutually perpendicular axes and less than 360 degrees about each of the second and third axes; and said movable motion of each of said arm means is independent of motion of the other arm means.

7. The arrangement defined in claim 6, wherein:

said pivotal motion of each of said arm means about each of said three axes is independent of pivotal motion about the other two axes.

8. The arrangement defined in claim 1, wherein:

said pivotal motion of said head means is 360 degrees.

9. The arrangement defined in claim 1, wherein:

said fourth axis is substantially perpendicular to said neck axis.

10. The arrangement defined in claim 1, wherein:

said hand simulating portion of said hand means further comprises finger simulating sections.

11. The arrangement defined in claim 1, wherein:

said hand simulating portion further comprises hook simulating portion.

12. The arrangement defined in claim 1, wherein:

said fifth axis is substantially parallel to said fourth axis.

13. The arrangement defined in claim 1, wherein:

said simulated knee joint further comprises:

first knee stop means on said knee end portion of said lower leg means for engaging said lower leg connecting portion of said upper leg to limit pivotal motion of said lower leg means toward said front wall of said body means, and a second knee stop means on said knee connecting portion of said lower leg means for engaging said lower leg connecting portion of said upper leg to limit pivotal motion of said lower leg toward said back wall of said body means.

14. The arrangement defined in claim 11, wherein:

said limited pivotal motion of said lower leg means at said simulated knee joint is approximately 90 degrees.

15. The arrangement defined in claim 1 and further comprising:

head covering means for detachably mounting on said head simulating portion of said head means.

16. The arrangement defined in claim 15, wherein:

said head covering means further comprises:

connecting portion positionable in said head covering connecting portion receiving aperture of said head means.

17. The arrangement defined in claim 15, wherein:

said head covering means further comprises hair simulating means.

18. The arrangement defined in claim 15, wherein:

said head covering means further coprises a simulated helmet means.

19. The arrangement defined in claim 1, wherein:

said hand means are detachably mounted on said arm means.

* * * * *